United States Patent [19]

Omote et al.

[11] Patent Number: 4,985,335

[45] Date of Patent: Jan. 15, 1991

[54] SELF-PROCESSING FILM UNIT

[75] Inventors: Hiroki Omote; Hideaki Kataoka, both of Kanagawa, Japan

[73] Assignee: Fuji Photo Film Co., Ltd., Kanagawa, Japan

[21] Appl. No.: 496,951

[22] Filed: Mar. 20, 1990

[30] Foreign Application Priority Data

Mar. 20, 1989 [JP] Japan ..... 1-68953
Feb. 23, 1990 [JP] Japan ..... 2-43737

[51] Int. Cl.[5] ..... G03C 3/00; G03D 5/02
[52] U.S. Cl. ..... 430/209; 354/304
[58] Field of Search ..... 430/209; 354/304

[56] References Cited

U.S. PATENT DOCUMENTS 4,247,626 1/1981 Poshkus et al. ..... 430/209
4,352,879 10/1982 Hara ..... 430/209
4,556,631 12/1985 Sato et al. ..... 430/209

FOREIGN PATENT DOCUMENTS 63156165 1/1990 Japan .

*Primary Examiner*—Richard L. Schilling
*Attorney, Agent, or Firm*—Young & Thompson

[57] ABSTRACT

A self-processing film unit wherein a cover sheet is formed with a first portion and a second portion extending from an opening defining an image forming area toward a trapping member, the first portion is longer than the second portion, and the first portion bounds an air venting passage. The first portion ensures that the distance that surplus processing solution must travel to reach the air venting passage will be long. Therefore, the surplus processing solution flowing around the first portion is less than the surplus processing solution flowing around the second portion. The leading portion of the surplus processing solution flowing around the first portion is thus pooled at a position far from the exit of the air venting passage. If an adhesive layer is disposed between the first portion and the trapping member, the air venting passage is circuitous and therefore prevention of leadkage is ensured. furthermore, by providing a small opening in a portion of the film unit where the air venting passage is located, leakage can also be prevented.

12 Claims, 5 Drawing Sheets

SELF-PROCESSING FILM UNIT

BACKGROUND OF THE INVENTION

This invention relates to a self-processing film unit which is used for an instant camera, and more particularly to an improvement of a leakage preventing structure of a self-processing film unit for preventing the leakage of surplus developing solution or processing solution from an air venting passage.

In a monosheet self-processing film unit (herein-after simply referred to as a "film unit") which is integrally formed of a photosensitive sheet, a mask sheet, a cover sheet, etc., a processing solution container is ruptured by spreading rollers after the photosensitive sheet has been exposed and a processing solution contained in the container is spread between the photosensitive sheet and a cover sheet over a predetermined width while pushing air from the film unit so as to be discharged from the air venting passage. One example of such an air venting passage is described in Japanese Patent Appln. No. Sho 63-156165. Although this Japanese application is not yet laid open, the general principles taught therein can be seen from the accompanying FIG. 14.

As seen in FIG. 14, this earlier arrangement is characterized in that an adhesive agent is applied to a mask sheet 2 in such a manner as to form a pattern thereon such that a portion with no adhesive agent applied thereto is formed on what is otherwise the adhering surfaces of the mask sheet 2 and the cover sheet 4. The portion with no adhesive agent applied thereto does not adhere to cover sheet 4 and so serves to define an air venting passage 5. Reference numeral 6 represents a photosensitive sheet.

In this earlier construction, when the processing solution 7 is spread, a surplus of processing solution is generated, although the quantity of such surplus processing solution is comparatively small. Such surplus processing solution forms a pool in a folded portion of the mask sheet 2. As is shown by arrows in FIG. 14, most of such surplus processing solution is caught by a trapping member 1, but a part of it reaches the inner end of the air venting passage 5 after passing through a gap between the trapping member 1 and the cover sheet 4. Although this surplus processing solution will ultimately be absorbed by the trapping member 1 and hardened, some time is required until the solution is completely absorbed. Therefore, although the surplus processing solution has a high viscosity immediately after it is spread, the solution nevertheless still has the possibility to flow. If a photographer carelessly grasps the nearby area of the trapping member 1 after processing, the surplus processing solution pooled in the vicinity of the air venting passage 5 sometimes leaks out through the air venting passage 5.

OBJECTS OF THE INVENTION v It is therefore a main object of the present invention to provide a film unit which is capable of preventing leakage of surplus processing solution through an air venting passage.

Another object of the invention is to provide a film unit which is simple in structure and yet capable of effectively preventing leakage of processing solution.

SUMMARY OF THE INVENTION

In order to achieve the above and other objects and features, a film unit according to the present invention includes a cover sheet, one end of which is formed with a first portion extending from the image forming area toward a nearby portion of a folded portion of a mask sheet, and a second portion having a shorter length than said first portion, said first portion bounding an air venting passage. It may be designed such that a plurality of first portions are provided on said cover sheet and an air venting passage is bounded by each of said first portions. Also, it may be designed such that a plurality of tiny holes are formed in a part of the mask sheet that overlaps the trapping member so that these holes provide air venting passages.

According to a preferred embodiment of the present invention, an adhesive layer is disposed between the first portion and the trapping member thereby to prevent liquid leakage from the air venting passage. Furthermore, the cover sheet may be provided with a plurality of openings formed in its one end near the trapping member so as to permit surplus processing solution to pass therethrough. Among these openings, the opening corresponding to the air venting passage may be formed smaller than the other openings and at a position shifted toward the edge of the cover sheet.

According to the present invention, the surplus processing solution is caused to follow an elongated path by the first portion of the cover sheet and the leading portion of the surplus processing solution is halted in a position away from the exit from the air venting passage. Therefore, leakage of the processing solution from the air venting passage can be effectively prevented.

DETAILED DESCRIPTION OF THE INVENTION

Figure 1:
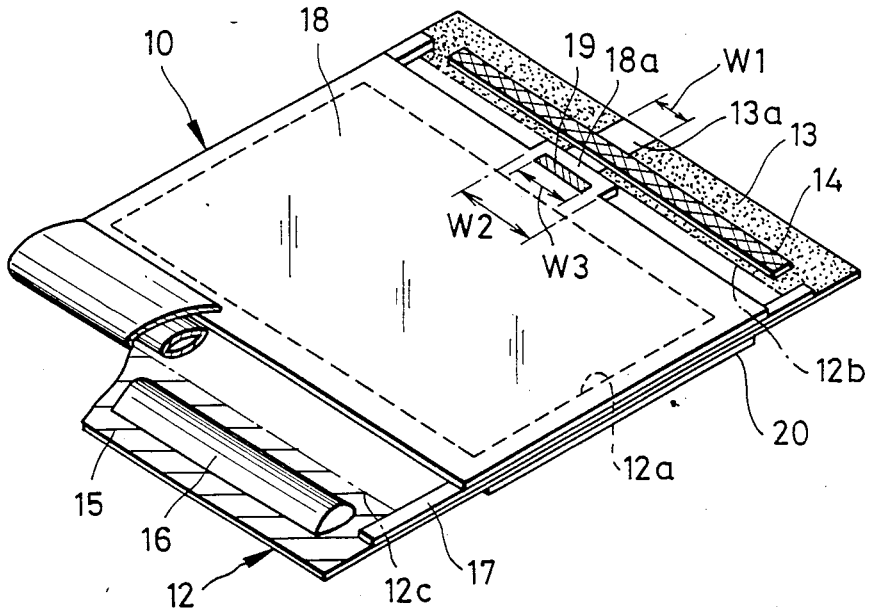
FIG. 1 is a perspective view of a first embodiment of the present invention wherein for clarity of illustration the mask sheet is shown unfolded so as to display the trapping member.

In FIG. 1 showing a film unit 10 of the present invention, a mask sheet 12 is formed of a comparatively thin plastic sheet and has an opening 12*a* defining an image forming area generally at its center. The mask sheet 12 is provided with folding lines 12*b* and 12*c* formed in opposite side portions of the opening 12*a* and further with an adhesive layer 13 having a non-coated area 13*a* formed endwise beyond the folding line 12*b*. The term "non-coated area" when used herein refers to an area where an adhesive agent is not applied. The adhesive layer 13 is formed by coating an adhesive agent or hot melt onto a marginal portion of the mask sheet 12 with a coating roller (not shown) having a groove portion corresponding to the non-coated area 13*a*. A trapping member 14 adapted to catch a surplus processing solution is welded to the mask sheet 12 by the adhesive layer 13 by a short-time heating sealing. At its other end, the mask sheet 12 is provided with a container 16 containing a processing solution welded endwise beyond the folding line 12*c* by an adhesive layer 15.

Elongated spacer rail members 17 are attached to an upper surface of the mask sheet 12 along opposite sides thereof and a transparent cover sheet 18 is attached thereto. A portion of the cover sheet 18 corresponding to the noncoated area 13*a* of the mask sheet 12 is provided with a projection 18*a* having a width W2 greater than the width W1 of the non-coated area 13*a* (preferably $W2 \approx 2W1$). The projection 18*a* is provided with an adhesive layer 19 coated thereon in order to heat seal a part of a lower surface of the trapping member 14. The width W3 of the adhesive layer 19 is determined in such a manner that $W2 > W3 > W1$. The adhesive layer 19 acts as a weir thereby to ensure the effect of preventing leakage.

Figure 2:
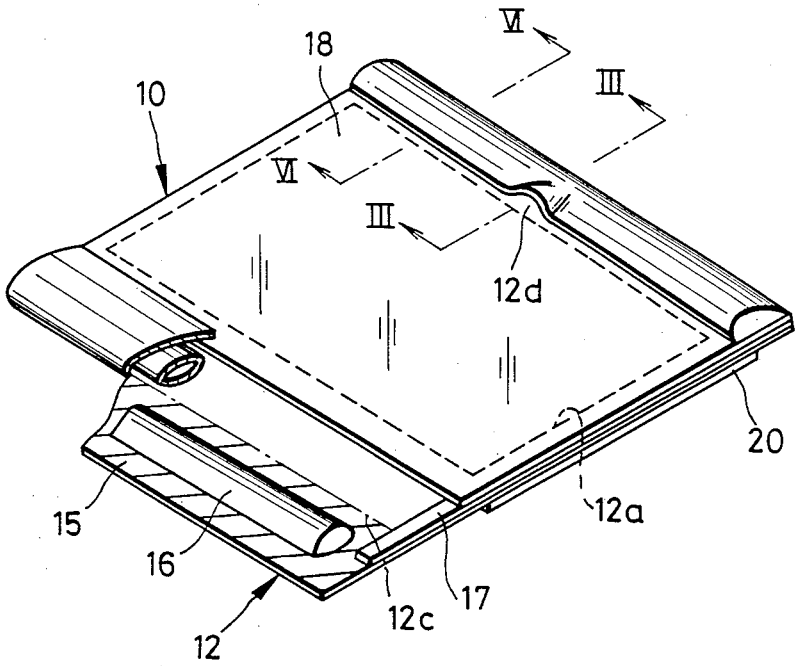
FIG. 2 is a perspective view similar to FIG. 1 wherein the mask sheet is folded back to form a flap which is secured to the cover sheet.

The spacer rail member 17 is formed of a blackened comparatively thick plastic strip. The member 17 is adapted to maintain a predetermined space between a photosensitive sheet as will be described hereinafter and the cover sheet 18 and serves to ensure that the processing solution will be spread to a uniform breadth therebetween. Also, the mask sheet 12 is folded back along the folding lines 12*b* and 12*c* in such a manner as to enclose the trapping member 14 and the processing solution container 16 and is firmly sealed to the cover sheet 18. In this way, the mask sheet 12 is firmly attached to the upper surface of the cover sheet 18 through the adhesive layer 13. At the same time, the mask sheet 12 is partly unattached to the cover sheet 18 by virtue of the provision of the non-coated area 13*a*. Accordingly, an air venting passage 12*d* is formed (see FIG. 2). The air venting passage 12*d* can be formed, as shown for example in Japanese Patent Appln. No. Hei 1-94749, by heat sealing using a baffle and withdrawing the baffle immediately thereafter.

Figure 3:
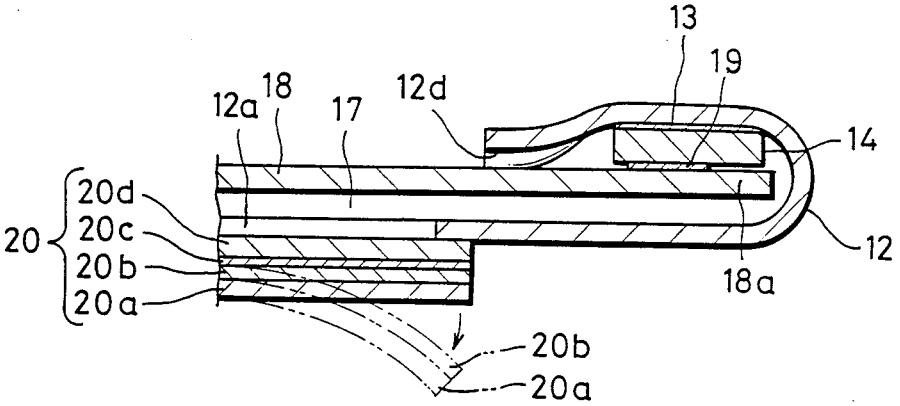
FIG. 3 is a sectional view taken on line III—III of FIG. 2 showing the structure before development.

Also, as is apparent from FIG. 3, a central portion of the trapping member 14 and the projection 18*a* are secured together by the adhesive layer 19. A part of the trapping member 14 on the same side as the image forming area overlaps the cover sheet 18. Examples of the adhesive of the layer 19 include a hardening type adhesive agent (heat sealing adhesive agents such as acrylic-type adhesive agents and EVA (ethylene-vinyl acetate copolymer) type adhesive agents), viscous agents (such as rubber-type and acrylic-type viscous agents), etc.

A photosensitive sheet 20 large enough to cover the opening 12*a* defining the image forming area is adhered to a lower surface of the mask sheet 12. The photosensitive sheet 20, as shown in FIG. 3, includes a base sheet 20*a*, an image-receiving layer 20*b* laid thereon, a peelable layer 20*c* further laid thereon, and a photosensitive layer 20*d* laid on the top thereof. The photosensitive layer 20*d* is firmly sealed to the lower surface of the mask sheet 12.

When taking a picture, light coming from the object passes through the cover sheet 18 and reaches the photosensitive layer 20*a* to record an image therein. Immediately after exposure, the exposed film unit 10 is moved by and between a pair of processing rollers (not shown) with the processing solution container 16 in the lead, and the container 16 is ruptured by the rollers in accordance with the well-known procedure. The processing solution contained in the container 16 is spread between the photosensitive layer 20*d* of the photosensitive sheet 20 and the cover sheet 18. In the meantime, air contained in the film unit 10 is pushed by the processing solution to pass through the gaps where the trapping member 14 and the cover sheet 18 are not secured together by the adhesive layer 19, and escapes to the outside of the film unit 10 through the air venting passage 12*d* formed between the cover sheet 18 and the mask sheet 12.

Figure 4:
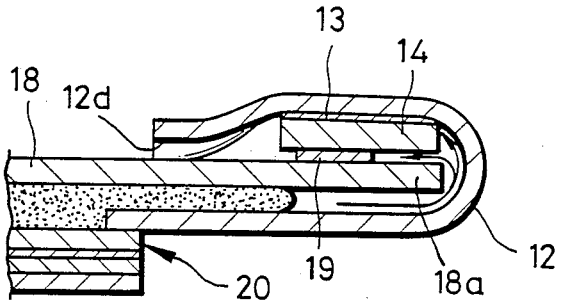
FIGS. 4 and 5 are sectional views similar to FIG. 3 showing successive stages of processing.
Figure 5:
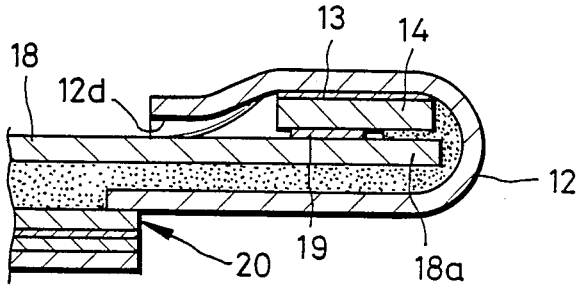

At the projection 18*a*, the surplus processing solution has no direct escape route, as shown by arrows in FIG. 4. Therefore, as is shown in FIG. 5 , only a very small amount of surplus processing solution reaches the trapping member 14 at that region. As a result, only a very small amount of processing solution can enter between the trapping member 14 and the projection 18*a*. Even if the folded portion of the mask sheet 12 is pushed, the surplus processing solution is absorbed by the trapping member 14 disposed in the midway and never emerges from the air venting passage 12*d* because the path to the exit of the air venting passage 12*d* is too long.

Figure 6:
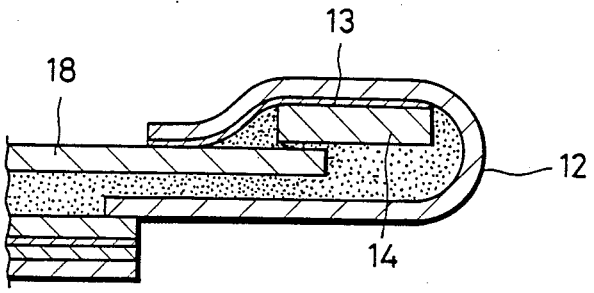
FIG. 6 is a sectional view taken on line VI—VI of FIG. 2 showing the structure during processing.

On the other hand, in the other regions of cover sheet 18 having no projection 18*a*, as shown in FIG. 6, as the path is short, the surplus processing solution reaches the trapping member 14 easily and most of it is caught by the trapping member 14. True, a portion of such processing solution passes through the gap between the trapping member 14 and the cover sheet 18 and reaches the space defined between the sheets 12 and 18 and the trapping member 14. However, as the sheets 12 and 18 are firmly sealed by the adhesive layer 13 in these regions, the processing solution cannot leak. Also, as the width of the projection 18*a* is greater than the width of the air venting passage 12*d*, the surplus processing solution does not leak out from the air venting passage 12*d* because of the circuitous path it would have to follow.

In this way, by virtue of the provision of the air venting passage 12*d* and the projection 18*a* of the cover sheet 18, the flow of the surplus processing solution an be controlled so that the surplus processing solution does not flow around and into the air venting passage 12*d*. Thus, leakage of the surplus processing solution can be effectively prevented.

When the processing solution is spread between the cover sheet 18 and the photosensitive layer 20*d* to a predetermined width, developing begins and an image formed in the photosensitive layer 20d is transferred to the image-receiving layer 20b as a positive image through the peelable layer 20c. And when the photosensitive sheet 20 is peeled off after a predetermined time for processing has passed, the photosensitive layer 20d and the peelable layer 20c are retained on the mask sheet 12 and a photographic sheet comprising the image-receiving layer 20b and the base sheet 20a is obtained.

Figure 7:
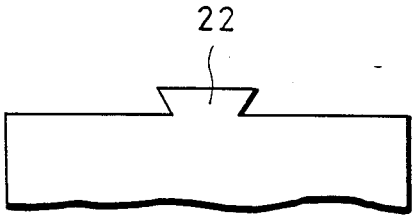
FIGS. 7 and 8 are plan views of a part of a mask sheet showing various alternative configurations of the extended portion of the cover sheet.
Figure 8:
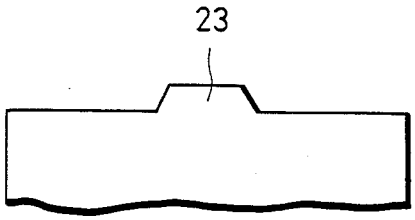
Figure 9:
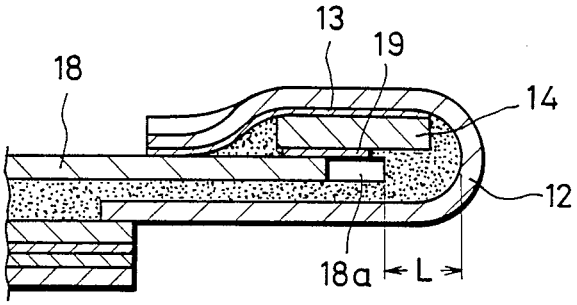
FIG. 9 is a sectional view showing an essential portion of a second embodiment of the present invention wherein the trapping member is extended beyond the end of the cover sheet in order to facilitate a smooth flow of the processing solution.

The configuration of the projection 18a of the cover sheet 18 may be that of a projection 22 having the shape of a dovetail groove 22 as shown in FIG. 7 or that of a projection 23 having the shape of a trapezoid as shown in FIG. 8.

In order to maintain a predetermined stream width of the processing solution so that it can flow smoothly, the distance L between the cover sheet 18 and the mask sheet 12 is made to be substantial, in order to oblige the surplus processing solution to flow a long way around to the trapping member 14. In this case, it suffices that the trapping member 14 is closer to folding line 12b of the mask sheet 12 than is the projection 18a. According to experiments, the length of the projection 18a is preferably at least 1 mm and more preferably about 3 mm in order effectively to prevent leakage of the surplus processing solution.

As described in the foregoing, if the adhesive layer 19 is disposed on an extension of the air venting passage 12d, leakage of the surplus processing solution can be prevented effectively. However, if the quantity of processing solution stored in the processing solution container 16 can be properly controlled, the surplus processing solution can be reduced.

Figure 10:
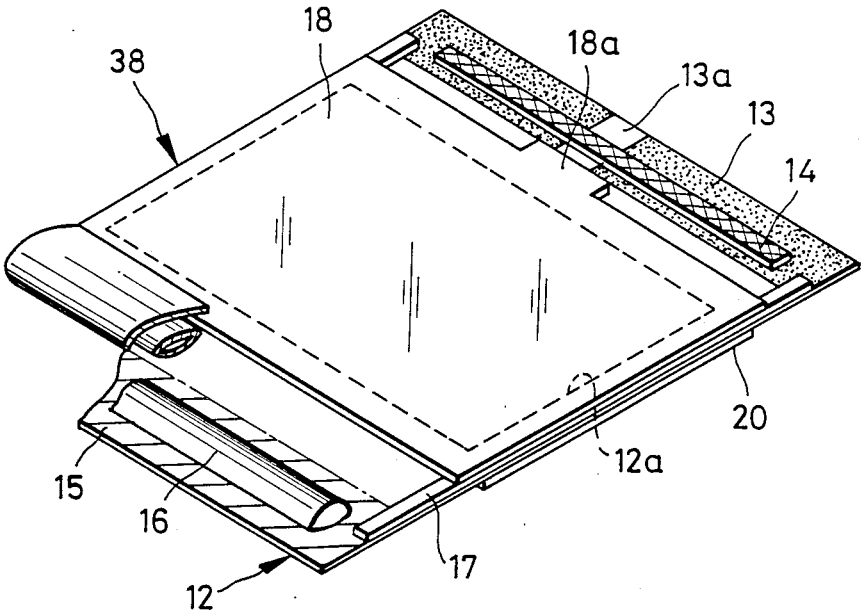
FIG. 10 is a perspective view of another embodiment of the present invention wherein an adhesive layer of FIG. 1 is omitted.

Therefore, even if the adhesive layer 19 is omitted as in a film unit 38 of FIG. 10, there can be obtained an effect of leakage prevention because the surplus processing solution does not reach the air venting passage.

Figure 11:
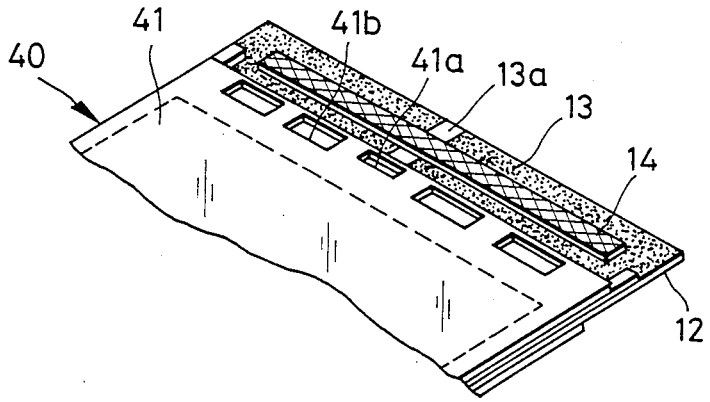
FIG. 11 is a fragmentary perspective view showing an essential portion of still another embodiment of the present invention wherein an opening corresponding to the air venting passage is formed to be comparatively small and at a position shifted toward the edge of the cover sheet.

In the embodiment of a film unit 40 shown in FIG. 11, a cover sheet 41 is provided with an opening 41a having a short width in the spreading direction of the processing solution and a plurality of openings 41b having a greater width likewise in the spreading direction of the processing solution, all of the openings 41a and 41b being formed in one end of the cover sheet 41 where a trapping member is formed. The opening 41a is formed in a position corresponding to the non-coated portion 13a and is offset toward the adjacent edge of the cover sheet 18 thereby to form a longer path. Therefore, as the quantity of the surplus processing solution flowing the long way around to the trapping member 14 from the opening 41a is much smaller than what can flow through the opening 41b, there can be obtained the effect of leakage prevention. Furthermore, as the cover sheet 41 has holes instead of cuts, handling of the cover sheet is easy during manufacture.

Figure 12:
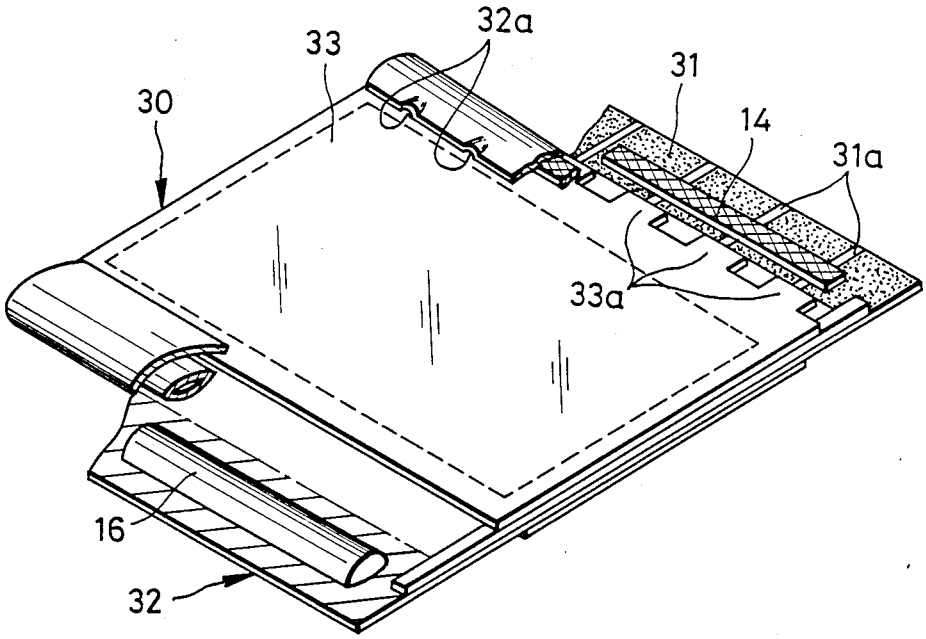
FIG. 12 is a perspective view of yet another embodiment of the present invention wherein a plurality of extended portions and air venting passages are formed.

FIG. 12 shows still another embodiment of the present invention. In a film unit 30 of this embodiment, a mask sheet 32 is provided with a plurality of non-coated areas 31a in an adhesive layer 31 and a plurality of corresponding air venting passages 32a, and a plurality of projections 33a are formed in cover sheet 33 is registry with the passages 32a.

Figure 13:
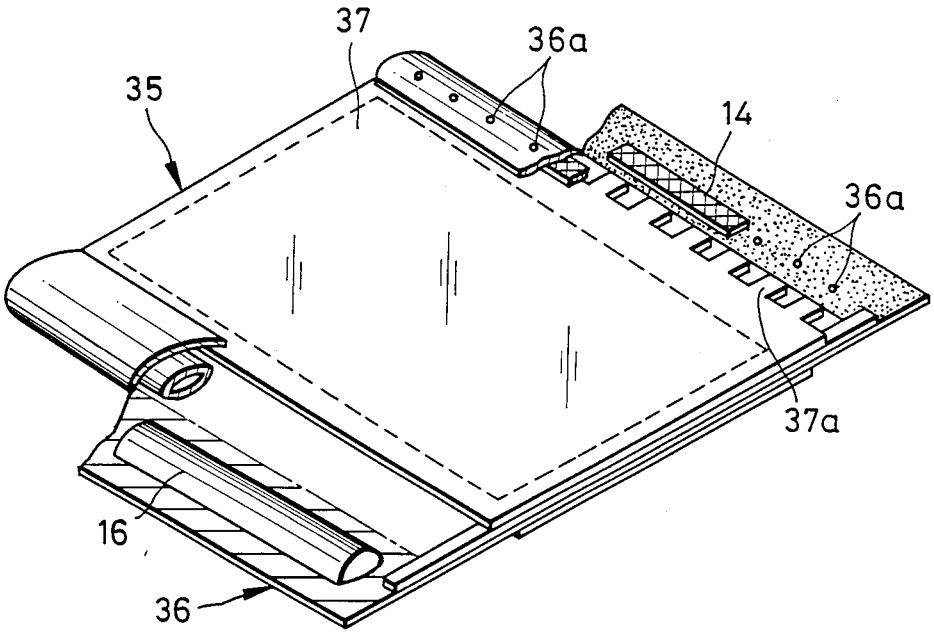
FIG. 13 is a perspective view of a further embodiment wherein an air venting passage is formed in a portion of the mask sheet contacting the trapping member.
Figure 14:
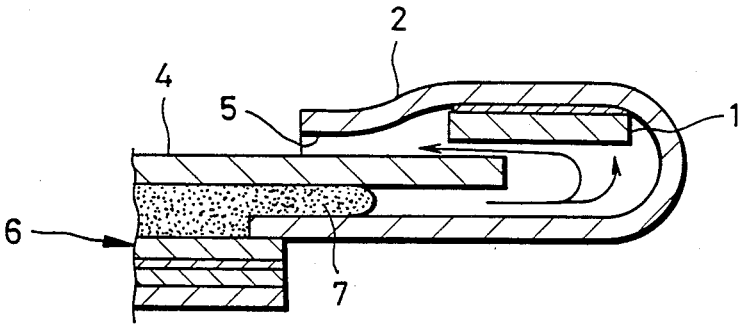
FIG. 14 (PRIOR ART)
FIG. 14 is a sectional view of an essential portion of the conventional film unit showing the flow of processing solution.

In a film unit 35 of the embodiment shown in FIG. 13, a mask sheet 36 is provided with a plurality of punched holes at its one end portion to which the trapping member 14 is adhered, thereby to form a plurality of air venting passages or holes 36a. A cover sheet 37 is provided with a plurality of projections 37a formed in registry with the air venting passages 36a.

The above-mentioned embodiment is a peelable monosheet type film unit in which a peelable layer is disposed between a photosensitive layer and an image-receiving layer, and a photograph-bearing sheet can be obtained by peeling off a base sheet supporting thereon an image-receiving layer after a photographic image is formed in the image-receiving layer. However, the present invention can also be applied to a known monosheet-type film unit which requires no peeling off operation after a photograph is taken. Furthermore, if an adhesive layer with a molded release sheet is provided on a lower surface of a photosensitive sheet, a photograph sheet can be directly attached to a photo album, etc. merely by peeling off the mold release sheet from the photograph sheet with an image recorded therein, and so this latter arrangement is quite convenient. In addition, the present invention can be changed and modified in various forms. It should be understood that such change and modification are also included in the purview and scope of the present invention as defined by the appended claims.

What is claimed is:

1. A self-processing film unit having a mask sheet which is provided with an opening defining an image forming area, a cover sheet closing said image forming area, a supply of processing solution, a trapping member which is adapted to catch surplus processing solution, one end of said mask sheet being folded back in such a manner as to enclose said trapping member and being secured to said cover sheet, an air venting passage being formed in said mask sheet, said cover sheet having first and second portions adjacent said trapping member, said first and second portions extending from away from said opening toward said folded back end, the length of said first portion being greater than the length of said second portion, said air venting passage registering with said first portion.

2. A self-processing film unit as claimed in claim 1, further including an adhesive layer disposed on said first portion, said adhesive layer being adhering a part of a lower surface of said trapping member.

3. A self-processing film unit as claimed in claim 2, wherein the width of said adhesive layer is greater than the width of said air venting passage.

4. A self-processing film unit as claimed in claim 3, wherein the width of said adhesive layer is less than the width of said first portion.

5. A self-processing film unit as claimed in claim 1, wherein said air venting passage is formed by a part of said mask sheet that is free from securement to said cover sheet.

6. A self-processing film unit as claimed in claim 5, wherein the width of said air venting passage is less than that of said first portion.

7. A self-processing film unit as claimed in claim 6, wherein said trapping member extends farther away from said opening than does said first portion.

8. A self-processing film unit having a mask sheet which is provided with an opening defining an image forming area, a cover sheet closing said image forming area, a supply of processing solution, a trapping member which is adapted to catch surplus processing solution, one end of said mask sheet being folded back in such a manner as to enclose said trapping member and being secured to said cover sheet, said cover sheet having a plurality of first portions and a plurality of second portions adjacent said trapping member, said first and second portions extending away from said opening toward said folded back end, said first and second portions being disposed in alternation to each other, the length of each of said first portions being greater than the length of each of said second portions, and a plurality of air venting passages bounded by each of said first portions of which a part is free from securement to adjacent parts of said mask sheet.

9. A self-processing film unit as claimed in claim 8, wherein the width of each of said air venting passages is less than the width of each of said first portions.

10. A self-processing film unit having a mask sheet which is provided with an opening defining an image forming area, a cover sheet closing said image forming area, a supply of processing solution, a trapping member which is adapted to catch surplus processing solution, one end of said mask sheet being folded back in such a manner as to enclose said trapping member and being secured to said cover sheet, said cover sheet having a plurality of first portions and a plurality of second portions adjacent said trapping member, said first and second portions extending away from said opening toward said folded back end, said first and second portions being disposed in alternation to each other, the length of each of said first portions being greater than the length of each of said second portions, and a plurality of tiny air holes in portions of said mask sheet contacting said trapping member above said first portions.

11. A self-processing film unit having a mask sheet which is provided with a framing opening defining an image forming area, a cover sheet closing said image forming area, a supply of processing solution, a trapping member which is adapted to catch surplus processing solution, one end of said mask sheet being folded back in such a manner as to enclose said trapping member and being secured to said cover sheet, a plurality of openings adapted to allow said surplus processing solution to pass therethrough, said openings being formed in said cover sheet adjacent said trapping member is located, at least one of said plurality of openings being narrower than others of said openings in a direction away from said framing opening and having its edge adjacent said framing opening disposed farther from said framing opening than are the edges of others of said openings, and an air venting passage formed by a part of said mask sheet located above said narrower opening which is free from securement to said cover sheet.

12. A self-processing film unit as claimed in claim 11, wherein the width of said air venting passage is less than the width of said narrower opening.

* * * * *